United States Patent [19]

Blevins

[11] 4,341,408

[45] Jul. 27, 1982

[54] TAMPERPROOF DEAD BOLT DEVICE

[76] Inventor: Paul Blevins, Rte. #3, Box 139, Bluefield, Va. 24605

[21] Appl. No.: 131,454

[22] Filed: Mar. 18, 1980

[51] Int. Cl.[3] ..... E05C 1/04; E05B 63/00

[52] U.S. Cl. ..... 292/150; 70/417

[58] Field of Search ..... 292/145, 150, 337, 357, 292/DIG. 51; 70/417

[56] References Cited

U.S. PATENT DOCUMENTS

| | | | |
|---|---|---|---|
| 264,438 | 9/1982 | Burrill | 292/145 |
| 313,328 | 3/1885 | Harris | 292/150 |
| 4,061,370 | 12/1977 | Hauber | 292/150 |

FOREIGN PATENT DOCUMENTS

| | | | |
|---|---|---|---|
| 996552 | 6/1965 | United Kingdom | 292/357 |

*Primary Examiner*—Robert L. Wolfe

*Attorney, Agent, or Firm*—John B. Dickman, III

[57] ABSTRACT

A tamperproof dead bolt device secured to a door jamb is disclosed including a stationary support plate assembly provided with a slotted section for a sliding dead bolt which in the secured position projects into the plane of the arc for opening the door. The dead bolt device further includes a lock member which prevents the dead bolt from being retracted from the secured position. When the dead bolt device is installed it is secured through the door jamb and wall partition to distribute the forces of an attempted forced entry over a larger surface area.

1 Claim, 6 Drawing Figures

TAMPERPROOF DEAD BOLT DEVICE

BACKGROUND OF THE INVENTION

Dead bolts are well known devices for securing a door against intruders. In general they include a surface mounted assembly for containing a bolt and a striker plate for receiving the bolt. A typical dead bolt is disclosed in U.S. Pat. No. 2,527,413 where the bolt is slidable within a slot in the surface mounted assembly to project into an opening in the striker plate. A similar dead bolt is disclosed in U.S. Pat. No. 2,620,213.

The problem with surface mounted dead bolts is they are mounted on the surface of a door or door jamb by wood screws which have limited gripping power. Usually four screws of less than an inch in length are employed to mount a dead bolt. It is obvious that a person could force the door by applying sufficient force against the bolt, pulling the screw out of the door.

Another type of surface mounted door securing device is disclosed in U.S. Pat. No. 3,674,297, directed to an interior door lock. The lock includes a plate mounted on a door jamb, between the edge of the door and the jamb, and a reciprocating latch which projects into the path of the door. With the door latched, the locking device is supposed to withstand attempted forced entry. This, of course, is not always true, since police reports advise that the screws are often ripped from the jamb, leaving the jamb in splingers.

In U.S. Pat. No. 3,347,581 a built-in latch for a metal door is disclosed. The latch projects through the edge of the door to engage a striker plate on a door jamb. Assuming the jamb is made of metal it would be less likely to yield to force. However, if the jamb is made of wood, the striker plate screws would subject to an applied force.

Obviously, a bolt and door and jamb combination could be built which would withstand attempted forced entry, but the cost of such a door and jamb would add substantially to already rising construction costs. It is also apparent from the rising number of break-ins that the present surface mounted dead bolts are not strong enough to prevent a determined burglar from forcing the bolt. The present invention has for its sole object to provide an inexpensive dead bolt which can be used on existing doors and in new construction.

SUMMARY OF THE INVENTION

The present invention relates to a dead bolt device having few moving parts, and, in particular, to a dead bolt device capable of preventing attempted forced entry.

In accomplishment of the foregoing features, a lock in accordance with the present invention includes a stationary support plate assembly with a slotted channel section for receiving and supporting a slidable dead bolt, and a back-up plate for preventing the support plate from being pulled or pried from its mounting on a door jamb. As stated the dead bolt is slidable in the slotted channel section, between obstructing and non-obstructing positions. There is also a latch mechanism to lock the dead bolt in the obstructing or non-obstructing positions.

Preferred Embodiment

Figure 1:
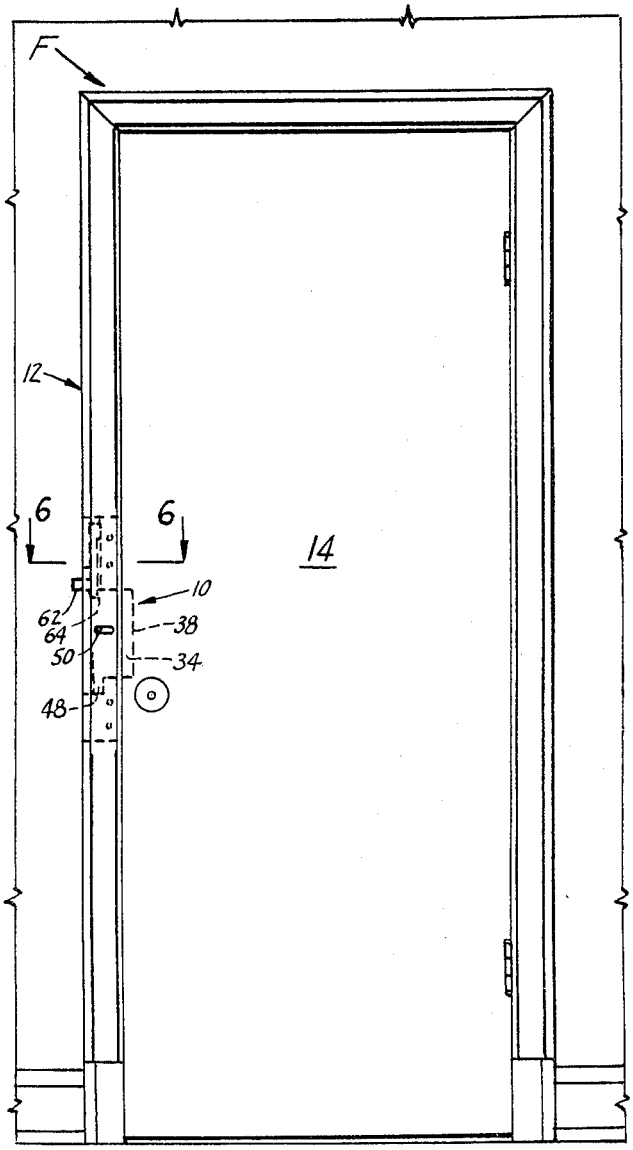
FIG. 1 is a front view of a door, door jamb, and the dead bolt device of this invention.
Figure 2:
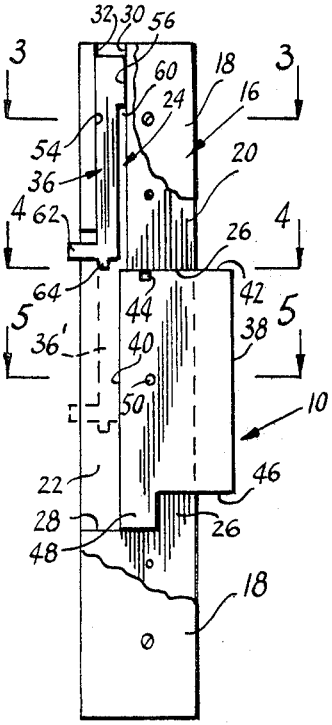
FIG. 2 is a front view of the dead bolt device of this invention.

Referring now to the drawings, there is shown in FIG. 1 a dead bolt device/10, in phantom lines, mounted on a door jamb 12, and a door 14. The door 14 is viewed from the inside to show the position of the dead bolt device in the non-access or locked position. Looking at FIG. 2, the dead bolt device 10 of the present invention includes a support plate assembly 16, with a top plate 18 partially removed. A bottom plate 20 is provided having a channel section 22 and an intersecting channel section 24. The channel section 22 is defined by a wall 26 forming the top edge of the channel and a wall 28 forming the bottom edge of the channel. The wall 28 further defines an abuttment 26, which will be described in detail later. The channel section 24 is defined by walls 30 and 32, where wall 32 is shorter than wall 30, the purpose of which will be explained later. Slidably supported in channel section 22 is a bolt plate 34, and slidably supported in channel 24 is a locking plate 36.

The bolt plate 34 is constructed from a flat metal sheet cut to provide a front edge 38 and a back edge 40. There is a top edge 42 with a notch 44, and a bottom edge 46. The bottom edge 46 also defines a projection 48. Secured to one side of the bolt plate 34 is a handle 50 which projects through a slot 52 (shown in FIG. 5) in top plate 18.

Referring to the locking plate 36, it includes a wall 32 engaging surface 54 and a wall 30 engaging surface 56. The wall 32 engaging surface 54 extends the length of the locking plate 36, while wall 30 engaging surface 56 only extends a short length of the locking plate, ending in a notched area 60. On the end of the locking plate 36 is hand grip 62 with a projection 64.

Considering the dead bolt device 10 further, and, in particular, the relationship of the parts. The locking plate 36 is placed in channel 24 with the end of the hand grip 62 protruding from the back of the dead bolt device 10.and the projection 64 facing channel 22. Next the bolt plate 34 is place in channel 22 with projection 48 riding on wall 28. The top plate 18 is bolted, riveted or otherwise affixed to bottm plate 20, with handle 50 protruding through slot 52 in the top plate.

The dead bolt device 10 is assembled such that when the bolt plate 34 projects from the front edge of the support plate assembly 16 the projection 48 on the bolt plate 34 engages the abuttment 36 on the bottom plate 20 to stop the bolt plate. With the bolt plate 34 in the non-access or locked position of FIG. 2, the locking plate 36 is slidable into the phantom line position 36' to prevent retraction of the bolt plate 34. It should be noted that notch area 60 of the locking plate 36 allows the locking plate to slide behind back edge 40 of the bolt plate 34, and that engagement of abuttment 26 and projection 48 allow sufficient movement of the bolt plate 34 for the locking plate to move into a locking position. The locking plate 36 also locks the bolt plate 34 inthe access or unlocked position by inserting projection 64 of the locking plate 36 in notch 44 of the bolt plate 34.

Figure 3:
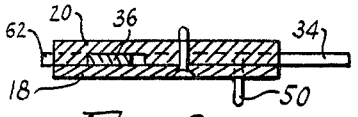
FIG. 3 is a cross-sectional view taken along the line 3-3 of FIG. 2.
Figure 4:
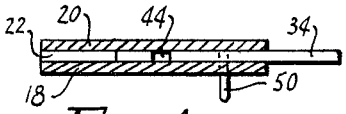
FIG. 4 is a cross-sectional view taken along the line 4-4 of FIG. 2.
Figure 5:
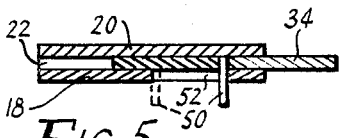
FIG. 5 is a cross-sectional view taken along the line 5-5 of FIG. 2.

Looking at FIGS. 3,4 and 5, the dead bolt device 10 is shown in cross-section with the bolt plate 34 in the nonaccess or locked access position.

Figure 6:
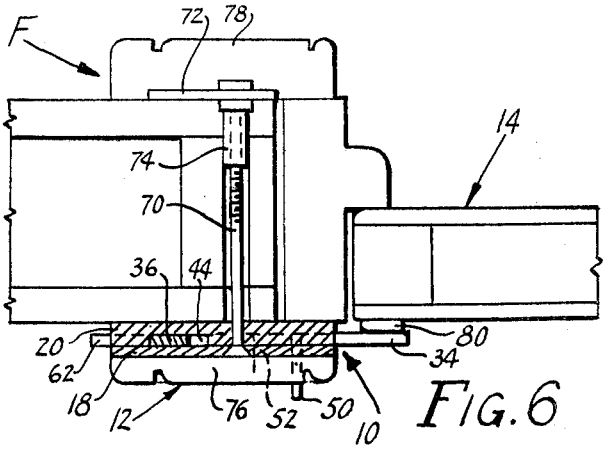
FIG. 6 is a cross-sectional view taken along the line 6-6 of FIG. 1.

Turning to FIG. 6, the dead bolt device 10 is shown secured to a door jamb 12. The dead bolt device 10 is mounted by drilling holes through the door frame F and placing the dead bolt device 10 on the inside of the building with supporting bolts 70 projecting through to the outside. A backup plate 72 with holes assigned to receive the ends of the bolts 70 is placed against the outside of the door frame F. The backing plate 72 may have nuts 74 welded to it, or the nuts may be applied through the holes in the backing plate. In some installations the backing plate may not be used, in which case there will be a decrease in holding force of the supporting bolts.

After the dead bolt device 10 is mounted, the door jamb molding 76 and 78 are nailed over the dead bolt device 10 and backing plate 72. The molding 76 and 78 having been routed to provide cavities to accommodate the dead bolt device 10 and the backing plate 72.

To operate the dead bolt device 10, the door 14 is shut and the bolt plate 34 is unlocked by lifting the hand grip 62 of locking plate 36. The bolt plate is slid into the nonaccess or locked position of FIGS. 2 or 6 and the locking plate 36 is moved into engagement with the back edge 40 of the bolt plate 36 to prevent it from being retracted. Should it be desired, the door 14 can be provided with a strike plate 80 to prevent the finish from being marred. Any attempted forced entry by applying force on the dead bolt will distribute the forces over a broad area of the frame F, rather than to small concentrated area.

While only one embodiment of the invention has been disclosed, it is obvious that one skilled in the art can modify the invention without departing from the scope of the invention, and therfore the following claims should be studied to obtain a full understanding of the invention:

I claim:

1. A dead bolt device comprising; a door frame mounted supporting plate assembly having means to secure said assembly on a door frame, said supporting plate assembly including a first plate and a second plate, said first plate having at least one channel means, a slidable member in at least one channel means where said slidable member is movable from an unlocked position to a locked position, and a locking means to lock said slidable member in the unlocked position or the locked position, said means to secure the supporting plate includes a first means extending from said supporting plate assembly through a door frame, and fastening means which fasten to said first means, said first means being threaded bolts and said fastening means are threaded nuts, a backing plate means having apertures to receive said threaded bolts aligned with said dead bolt device on the opposite side of the door frame before the threaded nuts are applied, said at least one channel means includes an abutment means, and said slidable member includes a projection to engage said abutment means, said first plate includes a second channel means in which said locking means is vertically slidable, said locking means includes a projection on said locking plate and a mating notch on said slidable bolt plate for locking said slidable bolt plate in an unlocked position, said locking means including a notched area for engaging the back edge of said slidable bolt plate, locking it in a locked position, said slidable bolt plate having a protruding operating handle and said locking means having a protruding hand grip.

* * * * *